United States Patent [19]

Litetar et al.

[11] Patent Number: 4,771,372

[45] Date of Patent: Sep. 13, 1988

[54] HEAD LAMP FOR DIMMING LIGHT OR FOG LIGHT OF MOTOR VEHICLES

[75] Inventors: Christian Litetar, Morges; Jean-Francois Longchamp, Lausanne, both of Switzerland

[73] Assignee: Robert Bosch GmbH, Stuttgart, Fed. Rep. of Germany

[21] Appl. No.: 931,446

[22] PCT Filed: Feb. 18, 1986

[86] PCT No.: PCT/DE86/00059

§ 371 Date: Sep. 22, 1986

§ 102(e) Date: Sep. 22, 1986

[87] PCT Pub. No.: WO86/05254

PCT Pub. Date: Sep. 12, 1986

[30] Foreign Application Priority Data

Feb. 28, 1985 [DE] Fed. Rep. of Germany ..... 3507013

[51] Int. Cl.[4] ..... F21V 7/00; F21L 7/00

[52] U.S. Cl. ..... 362/307; 362/187; 362/305; 362/299

[58] Field of Search ..... 362/307, 299, 300, 303, 362/305, 61, 343, 189; 350/448

[56] References Cited

U.S. PATENT DOCUMENTS

| | | | |
|---|---|---|---|
| 2,578,962 | 12/1951 | Bergmans et al. | 362/305 |
| 3,291,976 | 12/1966 | Rosenblatt | 362/305 |
| 3,708,221 | 1/1973 | Schaefer | 350/189 |
| 4,225,903 | 9/1980 | Buchleitner | 362/305 X |
| 4,454,570 | 6/1984 | Morello | 362/299 X |
| 4,607,318 | 8/1986 | Lindae et al. | 362/307 |

FOREIGN PATENT DOCUMENTS

| | | |
|---|---|---|
| 2636137 | 2/1978 | Fed. Rep. of Germany . |
| 856616 | 5/1941 | France . |
| 2503832 | 4/1981 | France . |
| 2550847 | 2/1985 | France . |

*Primary Examiner*—Larry Jones

*Attorney, Agent, or Firm*—Michael J. Striker

[57] ABSTRACT

A head lamp for motor vehicle dimming and fog lights having a reflector reflecting beams of a light source to form a light beam directed along a path, a diaphragm with an edge arrangable in the path, an achromatic lens arrangable in the path to portray an image of the edge as a light-dark border of the light beam on a roadway and a correction element arrangable in the path to at least reduce a color fringe otherwise present on the light-dark border of the light beam from chromatic aberration.

25 Claims, 2 Drawing Sheets

HEAD LAMP FOR DIMMING LIGHT OR FOG LIGHT OF MOTOR VEHICLES

BACKGROUND OF THE INVENTION

The invention relates to a head lamp for dimming light or fog light of motor vehicles. A head lamp is known from DE-OS No. 33 34 450, for example, whose lens must have a relatively large opening, so that the light beam illuminates the roadway sufficiently, and also sufficiently illuminate the edges thereof. The dispersion of the light beam, i.e., the splitting up of color of the light beam, in particular by the lens causes a color edge at the light-dark border of the light beam. This color edge, which is generated by color location errors, i.e. chromatic aberration, is annoying; moreover, such a light beam does not comply with legal requirements.

In order to eliminate this disadvantage, at least two lenses are used, of which at least one lens has a negative power of refraction. Such a multiple part lens requires considerable technical manufacturing efforst which is not acceptable for head lamps of motor vehicles.

SUMMARY OF THE INVENTION

It is an object of the present invention to provide a head lamp for dimming lights or fog lights or motor vehicles that eliminates or at least reduces undesirable color fringes from chromatic aberration.

In keeping with this object, and others that will become apparent hereafter, one aspect of the invention resides, briefly stated, in a head lamp for dimming lights or fog lights of motor vehicles that has means for reflecting beams of a light source to form a light beam directed along a path and including a reflector, a diaphragm having an edge arrangale in the path of the light beam; means for portraying an image of the diaphragm edge as a light-dark border of the light beam on a roadway when the light beam is directed along the path and the diaphragm edge is arranged in the path and including an achromatic lens arrangeable in the path after the light beam passes the diaphragm, and means for at least reducing a color fringe otherwise present on the light-dark border of the light beam from chromatic aberration and including a correction element arrangeable in the path of the light beam and associated with the achromatic lens.

DRAWING

A plurality of exemplified embodiments are illustrated in the drawing and are explained in more detail in the description of the figures. The figures illustrate:

FIG. 1 a schematic perspective illustration of a head lamp for dimming light of motor vehicles;

FIG. 2 the principle of the first embodiment in a noscale illustration;

FIG. 3 the principle of the second embodiment also in a nonscale illustration;

FIG. 4 a first modification of a connection element in a spatial image illustration in accordance with the second embodiment; and FIG. 5 a second modification in a spatial illustration of the second embodiment.

DETAILED DESCRIPTION OF THE PREFERRED EMBODIMENTS

Figure 1:
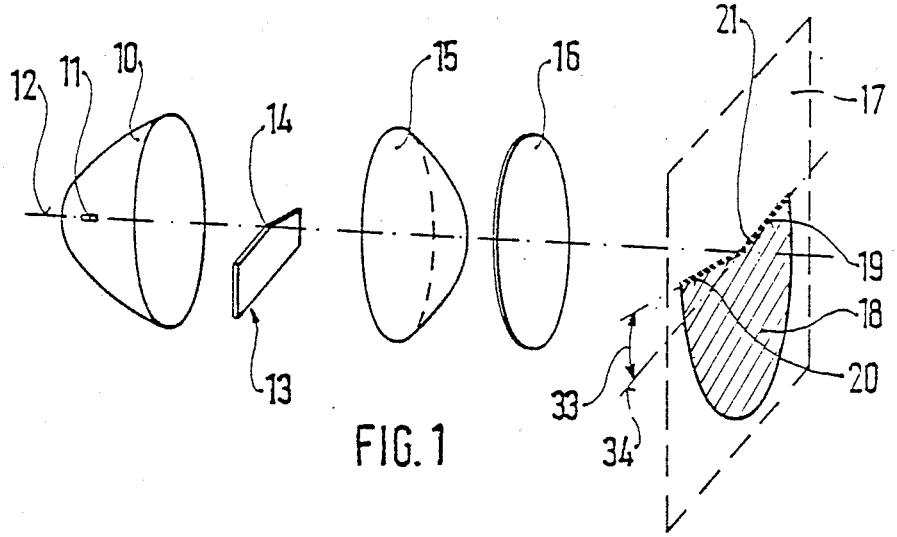

A head lamp for a dimminglight of motor vehicles has a reflector 10, a light source 11 which is defocussed relative to the focal point thereof and an optical axis 12.

The beams generated by the light source form a light beam 18 by reflection on reflector 10 and in whose beam path are provided a diaphragm 13 with a deflection edge 14, a lens 15 in front of the diaphragm 13 and whose color is not corrected (being afflicted with chromatic aberration) and a correction element 16 in front thereof represented by a disk.

The light beam 18 being transmitted from reflector 10 results as light spot with a light-dark border (LDB) on a measuring screen 17 which is disposed at a right angle with respect to axis 12, whereby the light-dark border has a horizontal branch 19 and an ascending branch 20 which ascends by 15 degrees with respect thereto. If the correction element 16 would not be present an annoying color edge 21 would be generated on the LDB 19, 20 caused by color location errors (chromatic aberration). However, when the correction element 16 is present in the beam path of the light beam 18, the LDB 19, 20 does not have this annoying color edge 21.

Figure 2:
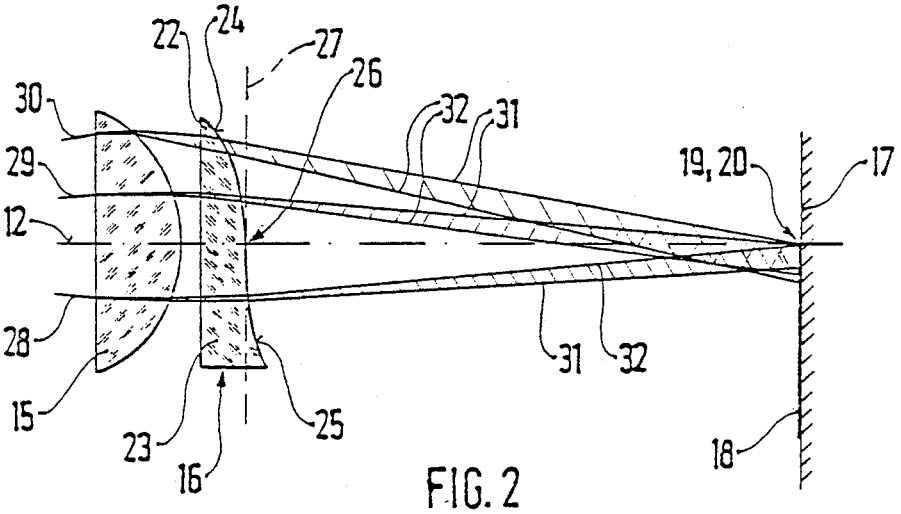

The correction element 16 in FIG. 2 consists of an upper semilens 22 and a lower cylindrical semilens 23, whose vertical section corresponds to a convrging or diverging lens. Both semilenses 22, 23 refract the light beams downwardly, whereby the refraction by the lower semilens 23 is different than that by the upper semilens 22. The optical axis of both semilenses 22, 23 is identical with the optical axis of lens 15, which in turn is identical with the optical axis 12 of the head lamp. The directrixes of surface 24 of the upper semilens 22 and the surface 25 of the lower semilens 23 are disposed parallel and horizontally with respect to each other. Both surfaces 24, 25 abut on a joint location 26 which contains the optical axis 12 and which are disposed with respect to this axis in a rectangular plane 27, whereby the two surfaces 24, 25 tangentially contact plane 27.

The effect of the correction element 16 is described in conjunction with three beams 28, 29 and 30 of light beam 18: Beams which are close to the axis (not illustrated) are hardly influenced by the noncolor corrected lens 15 and the correction element 16 and form the LDB 19, 20 of the light beam 18 without a color edge. The beam 29 being spaced away from the axis, is refracted while passing through the lens 15 and dispersed between its red beam component 31 and its blue beam component 32. Without the correction element 16 the beam 29 would, at least with its red beam component 31, impact above the LDB 19, 20 in the so-called dark range on the measuring screen 17; however, due to the upper semilens 22 of the correction element 16, the beam 29 is directed at least on or below the LDB 19, 20 and thereby to the light range of light beam 18.

The beam 30, which is close to the edge and which is most severly refracted and dispersed by lens 15, is directed downwardly by the upper semilens 22 of the correction element 16 in such a manner that its red beam component 31 also impacts at least on or below the LDB 19, 20 in the light range of light beam 18.

The beam 28, which is spaced away from the axis, is also refracted by lens 15 and dispersed into its red and blue beam component 31, 32. The semilens 23 of the correction element 16 directs the bea 28 at least so far in a downward direction that its blue beam component 32 impacts below th eLDB 19, 20 into the light range of the light beam 18. Therefore, the correction element 16 directs all beams forming a color edge 21 (FIG. 1) and which are subjected to the color location error into the light range of the light beam 18 where they mix.

A modification, now shown, with respect to the embodiment of FIG. 2 is where the upper and lower semilens of the correction element are axially symmetric.

With the asymmetric dimming light, the ascending branch 20 of the LDB encloses with the horizontal branch 19 an angle of 15 degrees, i.e., with the horizontal 34. For this purpose, preferably the directrixes of the surface of that lens half is inclined by the pitch angle (15 degrees) toward the horizontal 34 which forms the ascending branch 20.

Figure 3:
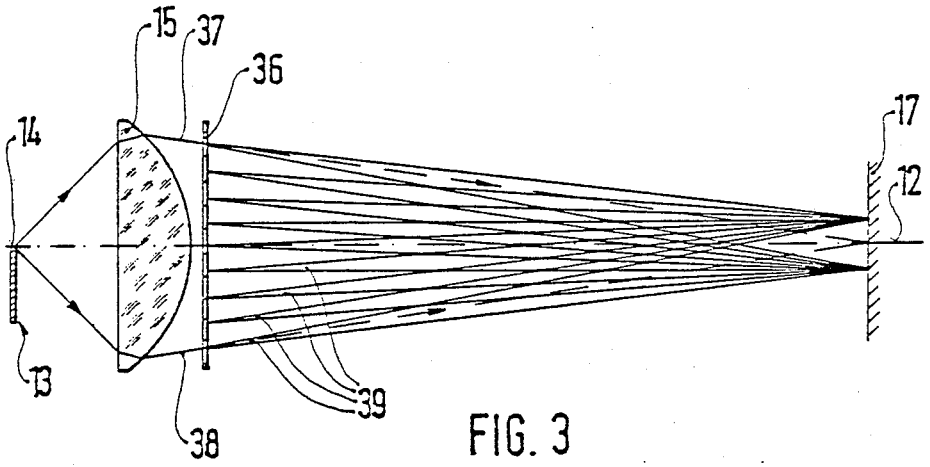

The correction element 36 of the second embodiment in FIG. 3 refracts the light beam, which emerges from lens 15, symbolizing the border beams 37, 38, into differential light beams, i.e., in many small light beams 39. These commonly superimpose and combine on the measuring screen 17, in case that the light beam emerging from the lens 15 is monochromatic. The LDB 19, 20 of the polychromatic light beam, not shown, is white with a light coloring.

Figure 4:
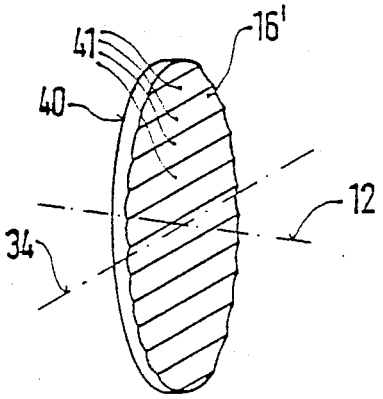

The correction element 16' in FIG. 4 has a substantially plane face 40 facing lens 15 and one face with a plurality of cylinder lenses 41 which contact each other and whose directrixes of the surfaces are disposed parallel and horizontally with respect to each other.

Figure 5:
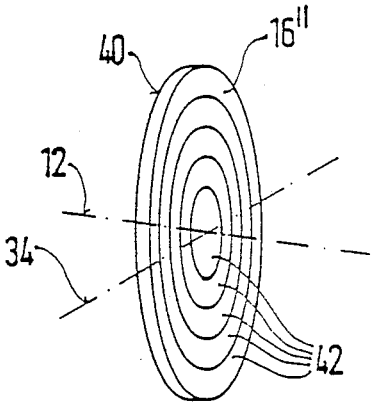

The correction element 16" in FIG. 5 is a modification of element 16' and also has a plane face 40 and annular lenses 42 which are axially symmetric with respect to the axis of lens 15 and thereby with respect to the axis 12 of the head lamp and contact each other.

The cylinder lenses 41 as well as the annular lenses 42 may be shaped as converging lenses or divrging lenses with different refraction power and/or width. Furthermore, these lenses have to only partially cover the effective face of the correction elements 16' or 16".

In a manner, not shown, the correction element may have a combination of lenses in accordance with one of claims 3 to 5 and 8 to 11. Moreover, the lens and the correction element may be made from one single piece, not shown, in which the face of the lens with the correcting element is made by molding.

We claim:

1. A head lamp for dimming lights or fog lights for motor vehicles, the head lamp comprising:

means for reflecting beams of a light source to form a light beam directed along a pat and including a reflector;

a diaphragm having an edge arranged in the path of the light beam;

means for projecting an image of said diaphragm edge as a light-dark border of the light beam on a roadway and including an achromatic lens arranged int he path after the light beam passes said diaphragm edge, said reflecting means being formed so that the light beam has a light area after passing through said achromatic lens and has color fringe beams which form a color fringe due to chromatic aberration; and means for at least reducing said color fringe otherwise present on the light-dark border of the light beam due to said chromatic aberration by directing said color fringe beams into the light area of the light beam and including a correction element arranged in the path of the light beam and associated with said achromatic lens, said correction element having upper and lower cylindrical semilenses, said semilenses being formed and arranged to refract the light beams downwardly, said upper semilens having a power of refraction different from that of said lower semilens, sid semilenses having a common junction and surface directrixes parallel to each other and meeting at said common junction, all of said projecting means, said reflecting means, and said semilenses having an optical axis common to each other.

2. A head lamp as defined in claim 1 wherein said means for at least reducing a color fringe is formed to eliminate said color fringe completely.

3. A head lamp as defined in claim 1, wherein said refraction power of said upper semilens is more positive than that of said lower semilens.

4. A head lamp as defined in claim 1, wherein said upper and lower semilenses are axially symmetric to each other.

5. A head lamp as defined in claim 4, wherein said reflecting means, said projecting means and said at least reducing means each have a common optical axis, said achromatic lens and said upper and lower semilenses being axially symmetric.

6. A head lamp as defined in claim 6, wherein said common junction is arranged to lie in said optical axis so that a plane perpendicular to said optical axis passes through said common junction and said surface directrixes touch said plane tangentially.

7. A head lamp as defined in claim 1, wherein said correction element is formed to refract emerging light beams from said achromatic lens into differential light beams that combine to form an achromatic light beam.

8. A head lamp as defined in claim 1, wherein said correction element has an effective area and a plurality of lenses at least artially covering said effective area.

9. A head lamp as defined in claim 1, wherein said achromatic lens and said correction element are each formed as a one piece member.

10. A head lamp as defined in claim 1, wherein said achromatic lens is formed as a molded element.

11. A head lamp for dimming lights or fog lights for motor vehicles, the head lamp comprising:

means for reflecting beams of a light source to form a light beam along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing a color fringe otherwise present on the light-dark border of the light beam from chromatic aberration and including a correction element arranged in the path of the light beam and associated with said achromatic lens, said correction element having upper and lower cylindrical semilenses, said semilneses being formed and arranged to refract the light beams downwardly, said upper semilens having a power of refraction different from that of said lowr semilens, said semilenses having a common junction and surface directrixes parallel to each other and meeting at said common junction, all of said projecting means, said reflecting means, and said semilenses having an optical axis common to each other, said common junction being arranged to lie in said optical axis so that a plane perpendicular to said optical axis passes through said common junction and said surface directrixes touch said plane tangentially, said upper and lower semilenses being parallel in a horizontal direction relative to each other.

12. A head lamp for dimming lights or fog lights for motor vehicles, the head lamp comprising:

means for reflecting beams of a light source to form a light beam directed along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing a color fringe otherwise present on the light-dark border of the light beam from chromatic aberration and including a correction element arranged in the path of light beam and associated with said achromatic lens, said correction element having upper and lower cylindrical semilenses, said semilenses being formed and arranged to refract the light beams downwardly, said upper semilens having a power of refraction different from that of said lower semilens, said semilenses having a common junction and surface directrixes parallel to each other and meeting at said common junction, all of said projecting means, said reflecting means, and said semilenses having an optical axis common to each other, said common junction being arranged to lie in sai doptical axis so that a plane perpendicular to sai doptical axis passes through said common junction and said surface directrixes touch said plane tangentially, said portraying means being formed so that said light-dark border has an upper edge with a center arranged in said optical axis and with an edge portion arranged horizontal from said center, said surface directrixes angling upward another edge portion of said upper edge about fifteen degrees relative to said horizontally arranged edge portion from said center whent helight beam passes through said correction element.

13. A head lamp for dimming lights or fog lights for motor vehicles, the head lamp comprising:

means for reflecting beams of a light source to form a light beam directed along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing said color fringe otherwise present on the light-dark border of the light beam from chromatic aberration and including a correction element arranged in the path of the light beam and associated with said achromatic lens, said correction element having a side composed of a plurality of cylinder lenses adjacent to and in contact with each other and having surface directrixes arranged parallel to each other.

14. A head lamp as defined in claim 13, wherein said surface directrixes of said cylinder lenses are horizontally parallel to each other.

15. A head lamp as defined in claim 13, wherein each of said cylinder lenses has a different power of refraction.

16. A head lamp as defined in claim 15, wherein each of said cylinder lenses has a different width.

17. A head lamp as defined in claim 15, wherein said cylinder lenses are formed as lenses selected from a group consisting of diverging and converging lenses.

18. A head lamp for dimming lights or fog lights for motor vehicles, the head lamp comprising:

means for reflecting beams of a light source to form a light beam directed along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing said color fringe otherwise present on the light-dark border of the light beam from chromatic aberration and including a correction element arranged in the path of the light beam and associated with said achromatic lens, said achromatic lens having an optical axis, said correction element having a side composed of a plurality of ring lenses adjacent to each other and axially symmetric with said optical axis.

19. A head lamp as defined in claim 18, wherein each of said ring lenses has a different power of refraction.

20. A head lamp as defined in claim 19, wherein each of said ring lenses has a different width.

21. A head lamp for dimming lights or fog lights for motor vehicles, the head lamp comprising:

means for reflecting beams of a light source to form a light beam directed along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing said color fringe otherwise present on the light-dark border of the light beam from chromatic aberraton and including a correction element arranged in the path of thelight beam and associated with said achromatic lens, said achromatic lens having an optical axis, said correction element having a side composed of a plurality of lenses of different shapes adjacent to each other and axially symmetric with said optical axis.

22. A head lamp as defined in claim 21, wherein said lenses are formed as lenses selected from a group consisting of converging and diverging lenses.

23. A head lamp as defined in claim 30, wherein said correction element is formed as a combination of a plurality of lenses selected from a group consisting of cylinder, ring, diverging, converging, and semi-lenses.

24. A head lamp for dimming lights or fog lights for motor vehicles, the head lamp comprising:

means for reflecting beams of a light source to form a light beam directed along a path and including a reflector;

a diaphragm having an edge arranged in the path of the light beam;

means for projecting an image of said diaphragm edge as a light-dark border of the light beam on a roadway and including an achromatic lens arranged in the path after the light beam passes said diaphragm edge; and means for at least reducing said color fringe otherwise present on the light-dark border of the light beam from chromatic aberration and including a correction element arranged in the path of the light beam and associated with said achromatic lens, said correction element having upper and lower cylindrical semilenses, said semilenses having a common junction and surface directrixes meeting at said common junction, said semilenses also having a common optical axis, said common junction being arranged to lie in said optical axis so that a plane perpendicular to said optical axis passes through said common junction and said surface directrixes touch said plane tangentially.

25. A head lamp as defined in claim 24, wherein said semilenses are formed to have different powers of refraction.

* * * * *